US008447206B2

(12) United States Patent
Yamamoto et al.

(10) Patent No.: US 8,447,206 B2
(45) Date of Patent: May 21, 2013

(54) IMAGE FORMING APPARATUS HAVING GUIDE BODY INCLUDING CHAMBER WHERE GAS MIXTURE IS FORMED AND FAN FOR DISCHARGING GAS MIXTURE

(75) Inventors: Koyo Yamamoto, Nisshin (JP); Hidekazu Nogami, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 259 days.

(21) Appl. No.: 12/891,856

(22) Filed: Sep. 28, 2010

(65) Prior Publication Data

US 2011/0103820 A1 May 5, 2011

(30) Foreign Application Priority Data

Oct. 30, 2009 (JP) ..... 2009-250449

(51) Int. Cl.
*G03G 21/20* (2006.01)

(52) U.S. Cl.
USPC ..... 399/93; 399/92

(58) Field of Classification Search
USPC ..... 399/92, 93
See application file for complete search history.

(56) References Cited

U.S. PATENT DOCUMENTS

2005/0271414 A1 12/2005 Katayama et al.

FOREIGN PATENT DOCUMENTS

| | | | |
|---|---|---|---|
| JP | 62-090684 | A | 4/1987 |
| JP | 02-287377 | A | 11/1990 |
| JP | 02-287571 | A | 11/1990 |
| JP | 5-023537 | A | 2/1993 |
| JP | 05-181210 | A | 7/1993 |
| JP | 6-019264 | A | 1/1994 |
| JP | 2001-117472 | A | 4/2001 |
| JP | 2001-194968 | A | 7/2001 |
| JP | 2005-017641 | A | 1/2005 |
| JP | 2005-148660 | A | 6/2005 |
| JP | 2006-018240 | A | 1/2006 |
| JP | 2007-057647 | A | 3/2007 |
| JP | 2008-268427 | A | 11/2008 |

OTHER PUBLICATIONS

JP Notice of Reasons for Rejection dated Sep. 6, 2011, corresponding Application No. JP 2009-250449; English Translation.

*Primary Examiner* — Hoang Ngo
(74) *Attorney, Agent, or Firm* — Banner & Witcoff, Ltd.

(57) ABSTRACT

An image forming apparatus includes an image forming unit configured to form an image on a recording medium, wherein a first gas is generated during image formation, and a fixing unit configured to fix the image onto the recording medium by heat, wherein a second gas is generated during image fixing by heat. A body includes a chamber and an opening through which the first gas and the second gas are guided into the chamber to be mixed into a gas mixture. A fan discharges the gas mixture from the chamber.

16 Claims, 6 Drawing Sheets

IMAGE FORMING APPARATUS HAVING GUIDE BODY INCLUDING CHAMBER WHERE GAS MIXTURE IS FORMED AND FAN FOR DISCHARGING GAS MIXTURE

CROSS REFERENCE TO RELATED APPLICATION

This application claims priority from Japanese Patent Application No. 2009-250449, filed on Oct. 30, 2009, the entire subject matter of which is incorporated herein by reference.

FIELD

Aspects of the disclosure relate to an image forming apparatus in which ozone and odor components may be generated in an apparatus body during image formation.

BACKGROUND

In an electrophotographic image forming apparatus, ozone and odor components may be generated inside an apparatus body during image formation. Ozone may be generated inside the apparatus body when electricity is discharged to form an image, for example, when a photosensitive member is charged by a charger. Odor components include volatile organic compounds, hereinafter referred to as VOCs. The VOCs may be generated inside the apparatus body when a recording medium having an image thereon is fixed by heat. The image forming apparatus needs to remove ozone and odor components generated during image formation and eject them outside the apparatus body.

To remove ozone and odor components from the apparatus body, the image forming apparatus is configured to merge air including ozone generated around the charger and air including VOCs generated around a fixing unit into a common path and to eject the merged air outside the apparatus body. With this configuration, the image forming apparatus ejects the air through a VOC oxidation catalyst filter or an ozone filter and uses the ozone as an oxidizing agent, thereby removing the ozone and VOCs from the air ejected outside the apparatus body.

The image forming apparatus removes ozone and VOCs mainly through the VOC oxidation catalyst filter and the ozone filter, and additionally uses the ozone as the oxidizing agent. In other words, the image forming apparatus is not provided with a structure to improve the advantages of ozone as the oxidation agent.

SUMMARY

Aspects of the disclosure provide an image forming apparatus that removes ozone and odor compounds which are generated inside an apparatus body during image formation by making use of the ozone.

BRIEF DESCRIPTION OF THE DRAWINGS

Illustrative aspects will be described in detail with reference to the following figures in which like elements are labeled with like numbers and in which.

DETAILED DESCRIPTION

Figure 1:
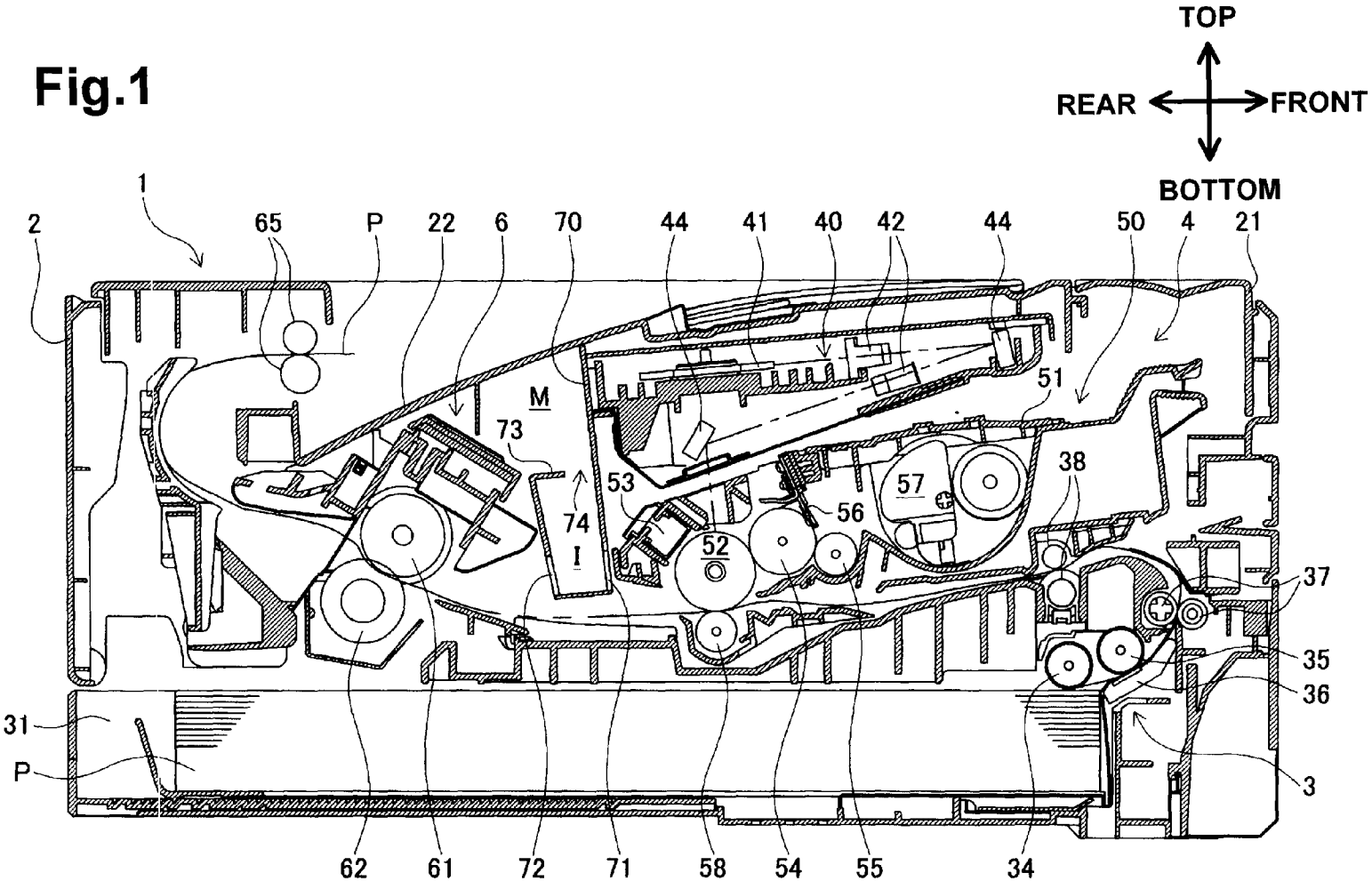
FIG. 1 is a central cross sectional view of a laser printer, as an example of an image forming apparatus using features described herein.

Illustrative embodiments will be described in detail with reference to the accompanying drawings.

A general structure of a laser printer 1 will be described with reference to FIG. 1.

For ease of discussion, in the following description, the top or upper side, the bottom or lower side, the left or left side, the right or right side, the front or front side, and the rear or rear side are used to define the various parts when the laser printer 1 is disposed in an orientation in which it is intended to be used. In FIG. 1, the right side is referred to as the front or front side, the left side is referred to as the rear or the rear side, the up side is referred to as the top or upper side, and the down side is referred to as the bottom or lower side.

The laser printer 1 includes a sheet supply unit 3, an image formation unit 4, and a fixing unit 6 in a main body 2. The main body 2 constitutes an apparatus body of the laser printer 1.

The front surface of the main body 2 contains a front cover 21 connected by hinges (not shown) to the main body 2. The front cover 21 can be opened to expose, an inside of the main body 2 and closed.

The upper surface of the main body 2 contains an output tray 22. The output tray 22 is configured to accommodate a stack of recording sheets P on which images are formed through the sheet supply unit 3, the image formation unit 4 and the fixing unit 6.

The sheet supply unit 3 of the laser printer 1 will be described in detail.

The sheet supply unit 3 is configured to supply a recording sheet P toward the image formation unit 4. The sheet supply unit 3 includes a sheet supply tray 31, a pickup roller 34, a sheet supply roller 35, a separation pad 36, a pair of feed rollers 37 and a pair of registration rollers 38.

The sheet supply tray 31 is detachably attached to a lower portion of the laser printer 1, and is configured to hold a stack of sheets P therein. The pickup roller 34 is rotatably disposed at upper front side of the sheet supply tray 31. The pickup roller 34 is configured to contact the uppermost sheet of the stack of sheets held in the sheet supply tray 31 and draw some upper sheets from the sheet supply tray 31 by rotating in contact with the upper sheet.

The sheet supply roller 35 and the separation pad 36 cooperate to separate the upper sheet P from some sheets P which are supplied by the pickup roller 34. The separation pad 36 is disposed under the sheet supply roller 35 and is configured to apply a resistance to the sheet fed by the sheet supply roller 35.

The feed rollers 37 are configured to contact the sheet P separated by the sheet supply roller 35 and the separation pad 36 and to feed the sheet P toward the registration rollers 38.

The registration rollers 38 are disposed downstream of the feed rollers 37 in a sheet feed direction. The registration rollers 38 are configured to contact the leading end of the sheet P, correct skew of the sheet P, and feed the sheet P toward the image formation unit 4.

The image formation unit 4 of the laser printer 1 will be described.

The image formation unit 4 includes an exposure unit 40 and a process cartridge 50, and is configured to form an image on the sheet supplied by the sheet supply unit 3.

The exposure unit 40 is disposed in an upper portion of the main body 2, and includes a laser emitting portion (not shown), a polygon mirror 41, lenses 42, and reflecting mirrors 44. The laser emitting portion emits laser light based on an image to be formed on the sheet P by the laser printer 1. As shown in FIG. 1, the laser light reaches the surface of a photosensitive drum 52 of the process cartridge 50 via the polygon mirror 41, the lenses 42, and the reflecting mirrors 44.

The process cartridge 50 is disposed under the exposure unit 40, and is detachably attached to the main body 2. The process cartridge 50 includes a hollow casing 51 in which the photosensitive drum 52, a charger 53, a developing roller 54, a supply roller 55, a layer thickness regulating blade 56, a toner chamber 57, and a transfer roller 58 are disposed.

The photosensitive drum 52 is rotatably supported in the casing 51, and includes a cylindrical, conductive drum body, which is coated with a positively chargeable photosensitive layer. On the photosensitive layer, an electrostatic latent image corresponding to an image is formed with laser light.

The charger 53 is disposed at the rear of the photosensitive drum 52 to face the photosensitive drum 52 through a predetermined distance therefrom. The charger 53 is configured to charge uniformly the outer circumferential surface of the photosensitive drum 52.

While the photosensitive drum 52 is charged by the charger 53, electricity reacts with oxygen in air to generate ozone inside the body frame 2. In this specification, a gas containing ozone generated during charging of the photosensitive drum 52 by the charger 53 is referred to as a first gas O.

The developing roller 54 is configured to supply toner to the electrostatic latent image formed on the photosensitive drum 52. The developing roller 54 is rotatably supported at the front of the photosensitive drum 52 and disposed to contact the photosensitive drum 52. The supply roller 55 is rotatably supported at the front of the developing roller 54 and disposed to contact the developing roller 54. The supply roller 55 is configured to supply toner to the developing roller 54 by rotating in contact therewith.

The layer thickness regulating blade 56 is configured to rotate in sliding contact with the developing roller 54 and regulate a layer thickness of toner carried on the developing roller 54. The toner chamber 57 is disposed at the front of the supply roller 55, and is configured to accommodate toner which is supplied to the photosensitive drum 52 via the developing roller 54 and the supply roller 55. The toner chamber 57 is provided with an agitator, of which reference number is omitted, configured in a manner known in the art.

The transfer roller 58 is rotatably supported under the photosensitive drum 52, and disposed in contact with the photosensitive drum 52. The transfer roller 58 is configured to be biased during image transfer under constant current control. When the transfer roller 58 is biased, it transfers toner carried on the circumferential surface of the photosensitive drum 52 onto the sheet P.

Toner in the toner chamber 57 is supplied to the supply roller 55 upon rotation of the agitator. As the supply roller 55 rotates in contact with the developing roller 54, toner supplied to the supply roller 55 is supplied to the developing roller 54. Toner supplied to the developing roller 54 goes in between the layer thickness regulating blade 56 and the developing roller 54 upon rotation of the developing roller 54, and is carried on the developing roller 54 as a thin layer of toner of uniform thickness. As the developing roller 54 and the photosensitive drum 52 rotate in contact with each other, toner carried on the developing roller 54 is supplied to the electrostatic latent image formed on the surface of the photosensitive drum 52. Thus, the latent image on the photosensitive drum 52 becomes visible.

As shown in FIG. 1, a guide body 70 is disposed between the image formation unit 4 and the fixing unit 6 inside the main body 2. The guide body 70 defines an introduction chamber I and a mixture chamber M in cooperation with inner wall surfaces of the main body 2 and an outer surface of the fixing unit 6.

The fixing unit 6 of the laser printer 1 will be described.

The fixing unit 6 is disposed at the rear of the process cartridge 50 or downstream thereof in the sheet feed direction. The fixing unit 6 includes a heat roller 61 and a pressure roller 62. The heat roller 61 is configured to heat and feed a sheet P on which an image is formed by the image formation unit 4. The pressure roller 62 is rotatably supported at a position facing the heat roller 61 and is configured to press the sheet P toward the heat roller 61. The fixing unit 6 is configured to melt toner transferred to the sheet P by heat and thermally fix the image onto the sheet P.

When the image is thermally fixed onto the sheet P, volatile organic compounds (hereinafter referred to as VOCs) are generated due to thermal fusing of toner. VOCs include chloroethylene. In this specification, a gas containing VOCs generated when the image is fixed by heat by the fixing unit 6 is referred to as a second gas V.

Above the fixing unit 6, a pair of ejection rollers 65 is rotatably disposed along the rear end of the output tray 22. The ejection rollers 65 are configured to eject the sheet P on which the image is fixed by the fixing unit 6 toward the output tray 22.

Operation of the laser printer 1 during image formation will be described with reference to FIG. 1.

When an instruction of image formation is executed, the pickup roller 34 rotates to draw some upper sheets P from the sheet supply tray 31 toward the sheet supply roller 35 and the separation pad 36, which are disposed downstream of the pickup roller 34 in the sheet feed direction and at the front of the pickup roller 34. The sheet supply roller 35 rotates to separate the uppermost sheet P from the sheets P drawn by the pickup roller 34 in cooperation with the separation pad 36 and supply the sheet P to the feed rollers 37, which are disposed downstream of the separation roller 35 in the sheet feed direction and at the front of the separation roller 35. The feed rollers 37 rotate to feed sheet P to the registration rollers 38, which are disposed downstream of the feed rollers 37 in the sheet feed direction and at the rear of the registration rollers 38. The sheet feed direction changes from the front to the rear while the sheet P is fed from the feed rollers 37 to the registration rollers 38. The registration rollers 38 contact the leading end of the sheet P to correct skew of the sheet P while rotating to feed the sheet P between the photosensitive drum 52 and the transfer roller 58.

When image formation is started, the charger 53 electrically charges the circumferential surface of the photosensitive drum 52 uniformly. As the leading end of the sheet P passes a predetermined position, the exposure unit 40 emits laser light toward the circumferential surface of the photosensitive drum 52 via the polygon mirror 41. With the laser light, the circumferential surface of the photosensitive drum 52 is exposed such that an electrostatic latent image based on image data is formed on the circumferential surface of the photosensitive drum 52. As the supply roller 55 and the developing roller 54 rotate, toner stored in the toner chamber 57 is supplied to the circumferential surface of the photosensitive drum 52. With the toner supplied, the electrostatic latent image formed on the circumferential surface of the photosensitive drum 52 is visualized into a toner image.

When the sheet P passes a position where the photosensitive drum 52 carrying the toner image and the transfer roller 58, the transfer roller 58 is biased. With the bias applied to the transfer roller 58, the toner image carried on the photosensitive drum 52 is transferred onto the sheet P. The photosensitive drum 52 and the transfer roller 58 rotate to feed the sheet P onto which the toner image has been transferred between the heat roller 61 and the pressure roller 62 in the fixing unit 6. While the heat roller 61 and the pressure roller 62 rotate to feed the sheet P toward the ejection rollers 68, the toner image is thermally fixed onto the sheet P. As the sheet P is fed from the fixing unit 6 to the ejection rollers 65, the sheet feed direction changes from the rear to the front. The ejection rollers 65 rotate to eject the sheet P outside the main body 2 or onto the output tray 22.

The guide body 70, the introduction chamber I and the mixture chamber M will be described with reference to FIGS. 1 to 3.

As described above, the guide body 70 is disposed between the image formation unit 4 and the fixing unit 6 in the main body 2. The guide body 70 partitions an area between the image formation unit 4 and the fixing unit 6 into the introduction chamber I and the mixture chamber M.

The introduction chamber I is defined by the inner wall surfaces of the guide body 70, and closed by right and left side frames (not shown) disposed inside the main body 2. Namely, the right and left sides of the introduction chamber I are closed. The first gas O and the second gas V are led to the introduction chamber I.

An upper portion of the introduction chamber I is defined by a partition wall 73 of the guide body 70. The partition wall 73 extends from a fixing unit 6 side toward an image formation unit 4 side or toward the front of the laser printer 1. A front end of the partition wall 73 is spaced through a predetermined distance from an inner wall surface of the guide body 70 disposed toward the image formation unit 4. In other words, an opening 74 is formed between the front end of the partition wall 73 and the inner wall surface of the guide body 70. The introduction chamber I and the mixture chamber M located above the introduction chamber I communicate with each other via the opening 74.

Figure 2:
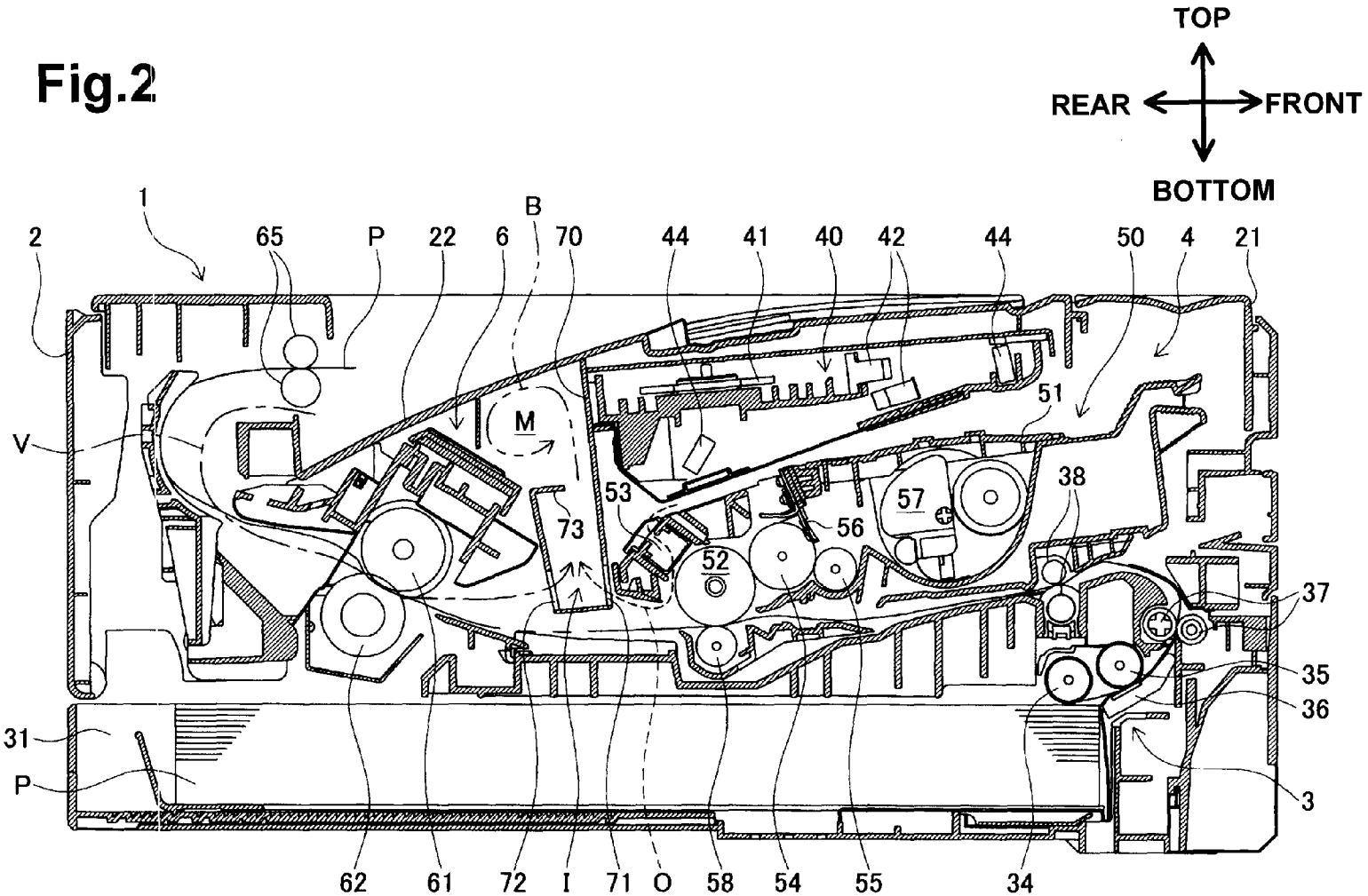
FIG. 2 illustrates air flow paths in the laser printer.
Figure 3:
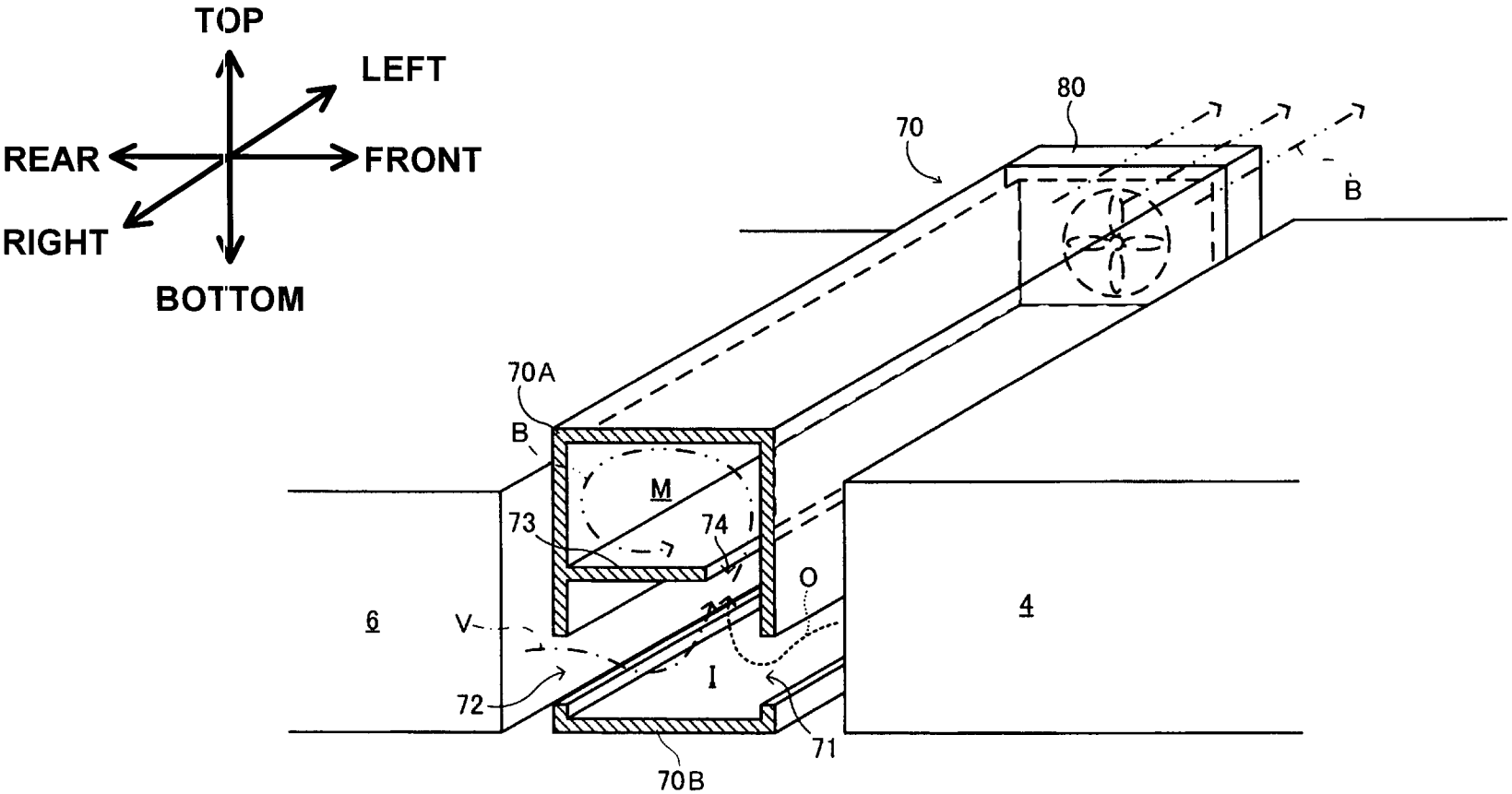
FIG. 3 is a perspective view schematically illustrating a configuration around an introduction chamber and a mixture chamber according to a first illustrative embodiment.
Figure 4:
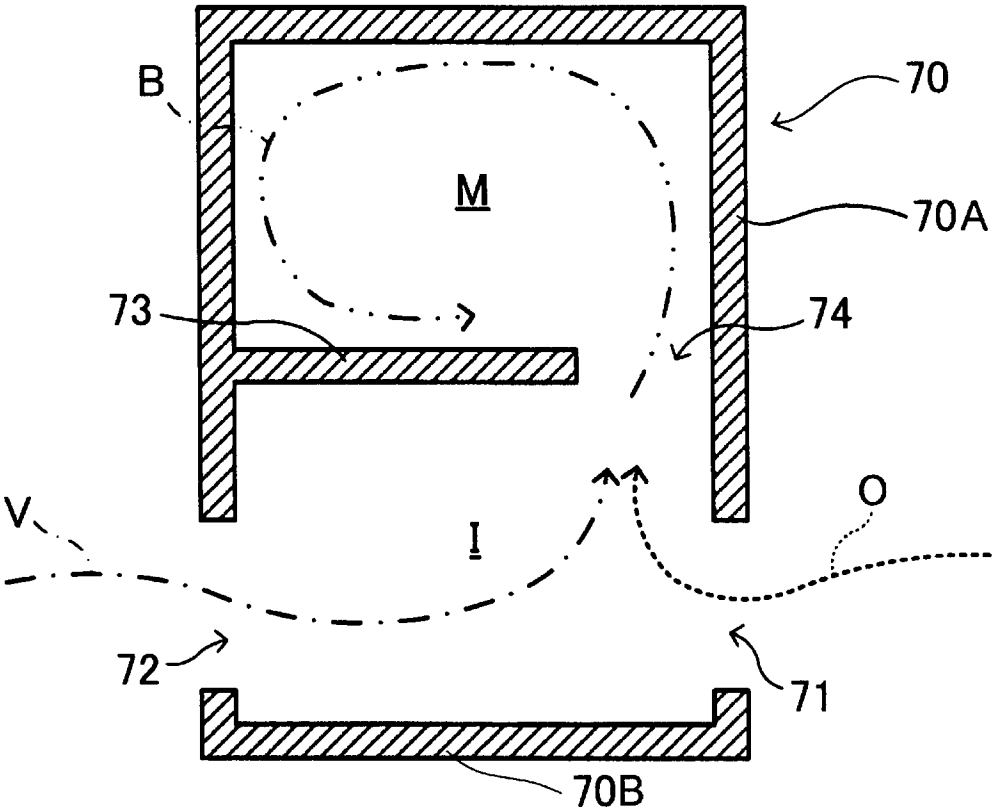
FIG. 4 is a cross sectional view schematically illustrating air flow paths in the introduction chamber and the mixture chamber.

As shown in FIG. 3, the guide body 70 extends in the right and left direction, and is formed of an upper member 70A having the partition wall 73 and a lower member 70B vertically spaced apart from the upper member. The upper member 70A is an example of a portion of the guide body 70 that defines the mixture chamber M. Part of the upper member 70A, the partition wall 73, and the lower member 70B are an example of a portion of the guide body 70 that defines the introduction chamber I. The guide body 70 has a first introduction opening or inlet 71 and a second introduction opening or inlet 72 between the upper member 70A and the lower member 70B. The first introduction opening 71 is formed on the front side of the introduction chamber I (close to the image formation unit 4), and is configured to guide the first gas O to the introduction chamber I as an exhaust fan 80 drives as shown in FIGS. 2 and 3. The second introduction opening 72 is formed on the rear side of the introduction chamber I (close to the fixing unit 6), and is configured to guide the second gas V as the exhaust fan 80 drives as shown in FIGS. 2 and 3. The introduction chamber I is configured to receive the first gas O and the second gas V and guide them to the opening 74.

The mixture chamber M is formed under the upper surface of the main body 2 and above the introduction chamber I. The mixture chamber M is defined by the guide body 70, an inner wall surface of the main body 2 that constitutes the rear surface of the output tray 22, and an outer surface of the fixing unit 6, and closed by the right and left side frames (not shown) as is the case with the introduction chamber I. Namely, the right and left sides of the mixture chamber M are closed. Thus, the laser printer 1 reduces the number of parts required for formation of the mixture chamber M.

It is desirable that there is no gap around the mixture chamber M between the chamber 70 and other parts including the inner wall surface of the main body 2 and the outer surface of the fixing unit 6. If there is a gap between the chamber 70 and other parts around the mixture chamber M, it is desirable to dispose, in the gap, an airtight part that blocks the gap and improves air tightness of the mixture chamber M. Alternatively, to improve air tightness of the mixture chamber M, walls of the guide body 70 near the gap may be provided in a complicated structure like a labyrinth.

As shown in FIG. 3, the exhaust fan 80 is disposed on one side of the mixture chamber M, e.g. a left side of the laser printer 1. The exhaust fan 80 is configured to discharge air from the main body 2 to outside the main body 2 in a predetermined exhaust direction. The predetermined exhaust direction is a direction from right to left in the main body 2.

As shown in FIGS. 1 and 2, the partition wall 73 and the opening 74 are located in the lower portion of the mixture chamber M. The mixture chamber M is separated from the introduction chamber I by the partition wall 73, and communicates with the introduction chamber I through the opening 74. The first gas O and the second gas V led to the introduction chamber I flow in the mixture chamber M through the opening 74. Thus, a gas mixture existing in the mixture chamber M contains the first gas O and the second gas V and will be referred to herein as a gas mixture B.

Figure 5:
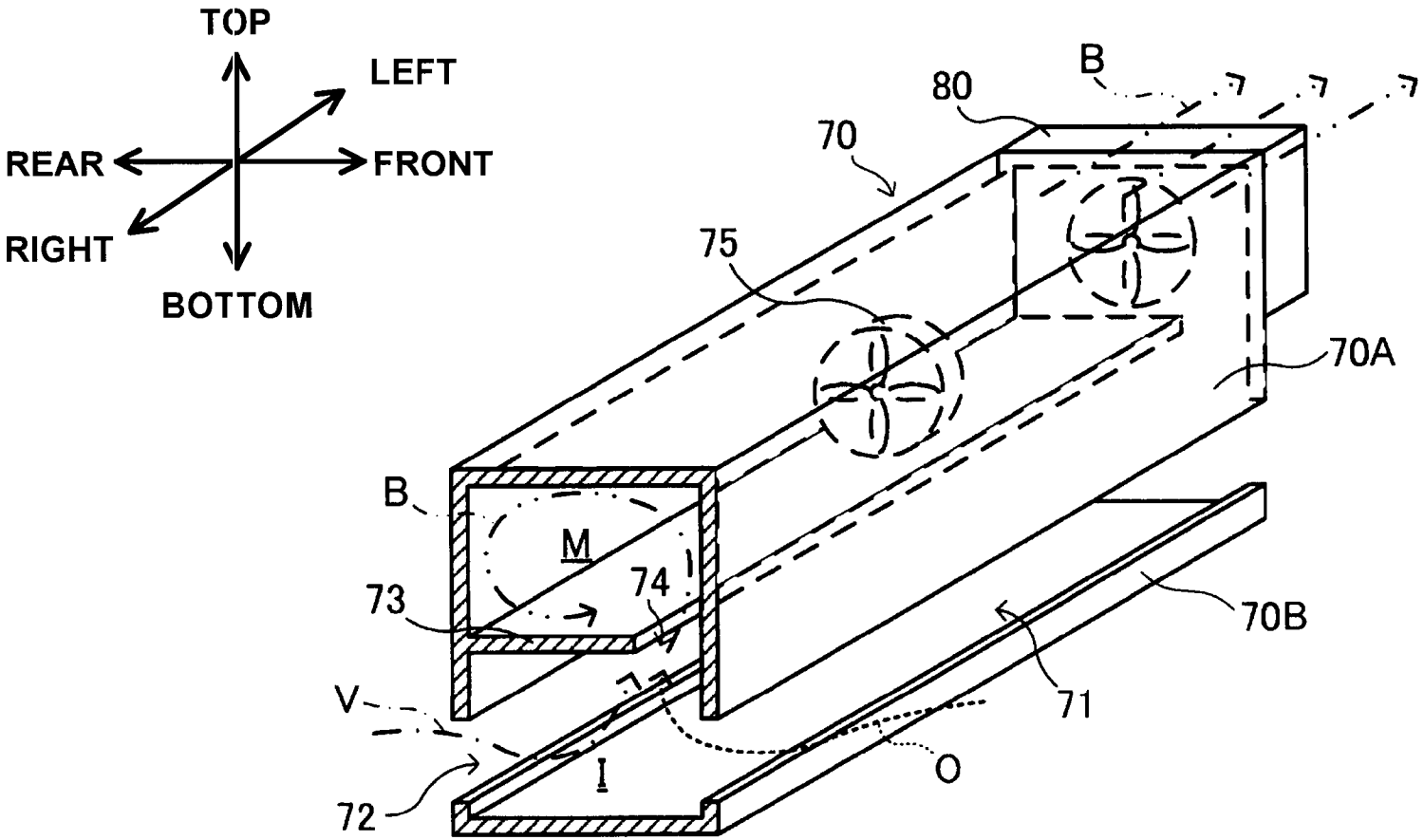
FIG. 5 is a perspective view illustrating an agitating member disposed in the mixture chamber.

As shown in FIG. 5, an agitating member 75 is disposed in the mixture chamber M. The agitating member 75 includes blades that are rotated by the air flow generated by the exhaust fan 80 in the exhaust direction. The agitating member 75 is rotatably supported by a shaft (not shown) horizontally extending in the left and right direction of the laser printer 1. The agitating member 75 rotates about the shaft when the exhaust fan 80 drives to cause air to flow in the exhaust direction.

As shown in FIGS. 1 and 2, the introduction chamber I and the mixture chamber M are defined by the guide body 70 disposed in a gap between the image formation unit 4 and the fixing unit 6. Ozone contained in the first gas O is generated by the charger 53 disposed in the image formation unit 4, and VOCs contained in the second gas V is generated by the fixing unit 6. Thus, in the laser printer 1, the first gas O and the second gas V can be led a short distance to the introduction chamber I.

The following will describe how the first gas O, the second gas V and the gas mixture B flow in the laser printer 1 with reference to FIG. 2.

When the exhaust fan 80 drives, air existing in the mixture chamber M is discharged outside the main body 2, and air existing in the introduction chamber I is led to the mixture chamber M. Concurrently, air existing around the image formation unit 4, especially around the charger 53, is led to the introduction chamber I via the first introduction opening 71, and air existing around the fixing unit 6 is led to the introduction chamber I via the second introduction opening 72.

As shown in FIG. 2, the first gas O containing ozone generated around the charger 53 in the image formation unit 4 is led to the introduction chamber I via the first introduction opening 71 as the exhaust fan 80 drives. Concurrently, the second gas V containing VOCs generated in the fixing unit 6 is led to the introduction chamber I via the second introduction opening 72.

Thus, the first gas O and the second gas V exist in the introduction chamber I. In other words, the introduction chamber I contains ozone generated by the charger 53 and VOCs generated in the fixing unit 6. As shown in FIG. 2, the first introduction opening 71 is formed opposite the second introduction opening 72 via the introduction chamber I. In the laser printer 1, the first gas O containing ozone and the second gas V containing VOCs are led to the introduction chamber I, and further led to the mixture chamber M through the opening 74 to be mixed into the gas mixture B.

As shown in FIGS. 2-5, the opening 74 has a cross sectional area narrower than a cross sectional area of the mixture chamber M in a cross section parallel to the partition wall 73 or the opening 74. Thus, the gas mixture B led to the mixture chamber M through the opening 74 is distributed and agitated in the mixture chamber M.

Specifically, in this illustrative embodiment, the opening 74 is formed along an inner wall surface of the guide body 70, which is located at the front side of the laser printer 1. In the mixture chamber M, the flow of the gas mixture B forms or draws a counterclockwise whirl in the vertical direction. As the exhaust fan 80 continues to drive, the gas mixture B still flows in the mixture chamber M in the exhaust direction. In other words, the gas mixture B flows in the exhaust direction while continuing to form a whirl in the mixture chamber M.

With the spiral flow of the gas mixture B, ozone and VOCs contained in the gas mixture B are substantially uniformly distributed in the mixture chamber M, and an oxidation-reduction reaction between ozone and VOCs in the mixture chamber M is promoted.

The agitating member 75 is disposed in the mixture chamber M. The agitating member 75 is configured to rotate with an air flow in the exhaust direction produced by the exhaust fan 80. With this configuration, the gas mixture B in the mixture chamber M is agitated, and ozone and VOCs contained in the gas mixture B are substantially uniformly distributed in the mixture chamber M. In the laser printer 1, the gas mixture B is agitated by the agitating member 75, and the oxidation-reduction reaction between ozone and VOCs in the mixture chamber M is promoted.

As the oxidation-reduction reaction between ozone and VOCs in the mixture chamber M occurs, ozone and VOCs changes into different substances respectively. Thus, air discharged by the exhaust fan 80 becomes free of ozone and VOCs. The laser printer 1 can promote the oxidation-reduction reaction between ozone and VOCs, and effectively remove ozone and VOCs from a gas discharged from the laser printer 1.

As described above, the guide body 70 forming the introduction chamber I and the mixture chamber M is disposed between the image formation unit 4 and the fixing unit 6 in the laser printer 1 in this illustrative embodiment. The introduction chamber I communicates with the inside of the main body 2 through the first and second introduction openings 71 and 72, and communicates with the mixture chamber M through the opening 74. The exhaust fan 80 and the agitating member 75 are disposed in the mixture chamber M.

The first gas O containing ozone generated at the charger 53 is led to the introduction chamber I via the first introduction opening 71 by the exhaust fan 80. The second gas V containing VOCs generated in the fixing unit 6 is led to the introduction chamber I via the second introduction opening 72 by the exhaust fan 80.

Air existing in the introduction chamber I is led to the mixture chamber M through the opening 74 formed along the inner wall surface of the guide body 70 located on the image formation unit 4 side. The gas mixture B led to the mixture chamber M flows in the exhaust direction while drawing or forming a whirl in a vertical cross section. As the gas mixture B flows in the mixture chamber M while forming a whirl, the laser printer 1 can promote the oxidation-reduction reaction between ozone and VOCs contained in the gas mixture B. Thus, the laser printer 1 can make effective use of ozone contained in the first gas O to efficiently remove ozone and VOCs from a gas discharged from the mixture chamber M to outside of the main body 2.

The agitating member 75 is disposed in the mixture chamber M, rotates with an air flow in the exhaust direction produced by the exhaust fan 80 and agitates the gas mixture B. By using the agitating member 75, the laser printer 1 can promote the oxidation reduction reaction between ozone and VOCs contained in the gas mixture B. As a result, the laser printer 1 can make effective use of ozone contained in the first gas O and efficiently remove ozone and VOCs from air to be discharged outside the main body 2.

A second illustrative embodiment will be described with reference to FIG. 6. The second illustrative embodiment of the disclosure also applies to the laser printer 1.

The laser printer 1 of the second illustrative embodiment is identical in structure to that of the first illustrative embodiment, but different in structure of the introduction chamber I and the mixture chamber M. Thus, the following description will be made as to the introduction chamber I and the mixture chamber M of the second illustrative embodiment.

As in the case of the first illustrative embodiment, the introduction chamber I and the mixture chamber M of the second illustrative embodiment are defined by the guide body 70 disposed between the image formation unit 4 and the fixing unit 6. The introduction chamber I of the second illustrative embodiment is defined by the inner wall surfaces of the guide body 70 and the side frames (not shown), and includes the first introduction opening 71 and the second introduction opening 72. The mixture chamber M of the second illustrative embodiment is defined by the inner wall surfaces of the guide body 70, the inner wall surface of the main body 2 that constitutes the rear surface of the output tray 22, the outer surface of the fixing unit 6, and the side frames (not shown). The exhaust fan 80 is attached to one side of the mixture chamber M. In addition, the agitating member 75 is disposed in the mixture chamber M as in the case of the first illustrative embodiment.

In the second illustrative embodiment, the guide body 70 is formed with partition walls 73 which are located above the introduction chamber I. As shown in FIG. 6, one partition wall 73 protrudes from an inner wall surface of the guide body 70 that is disposed on the image formation unit 4 side, the other partition wall 73 protrudes from an inner wall surface of the guide body 70 that is disposed on the fixing unit 6 side, and the partition walls 73 generally horizontally protrude toward each other. A space formed between the partition walls 73 functions as the opening 74 of the second illustrative embodiment. As in the case of the first illustrative embodiment, the opening 74 of the second illustrative embodiment has a cross sectional area narrower than a cross sectional area of the mixture chamber M in a cross section parallel to the partition walls 73. Thus, even in the second illustrative embodiment, the gas mixture B led to the mixture chamber M through the opening 74 is distributed and agitated in the mixture chamber M.

Figure 6:
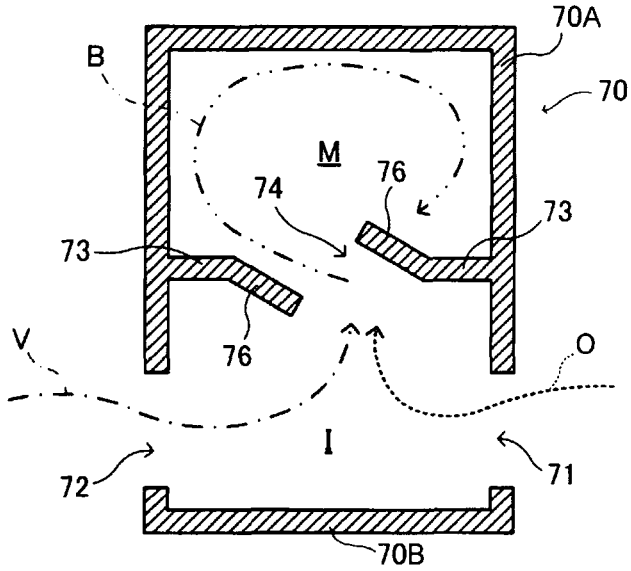
FIG. 6 is a cross sectional view schematically illustrating air flow paths in the introduction chamber and the mixture chamber according to a second illustrative embodiment.

As shown in FIG. 6, the partition walls 73 are formed with respective guide portions 76 at their distal ends. The guide portions 76 define the opening 74 and are inclined at a predetermined angle with respect to the respective partition walls 73.

Air flow in the introduction chamber I and the mixture chamber M in the second illustrative embodiment will be described.

As in the case of the first illustrative embodiment, when the exhaust fan 80 drives, the first gas O containing ozone is led to the introduction chamber I via the first introduction opening 71. Concurrently, the second gas V containing VOCs is led to the introduction chamber I via the second introduction opening 72.

Air existing in the introduction chamber I is led to the mixture chamber M via the opening 74, as in the case of the first illustrative embodiment. In the second illustrative embodiment, the guide portions 76 define the opening 74. As shown in FIG. 6, one guide portion 76 located on the image formation unit 4 side (on the right side of FIG. 6) is inclined upward at a predetermined angle, and the other guide portion 76 located on the fixing unit 6 side (on the left side of FIG. 6) is inclined downward at a predetermined angle. Thus, the guide portions 76 guide air, which is led from the introduction chamber I to the mixture chamber M, toward an inner wall surface of the mixture chamber M located on the fixing unit 6 side.

In the mixture chamber M, the gas mixture B flows along the inner wall surfaces of the mixture chamber M as if it draws a clockwise whirl in the vertical cross section. With this flow, the gas mixture B in the mixture chamber M can be greatly agitated. As a result, the laser printer 1 of the second illustrative embodiment can promote an oxidation-reduction reaction between ozone contained in the first gas O and VOCs contained in the second gas V, and effectively remove ozone and VOCs from air to be discharged by the exhaust fan 80.

In the laser printer 1 of the second illustrative embodiment, it is clear that effects similar to those brought about by the first illustrative embodiment can be appreciated. In addition, the laser printer 1 of the second illustrative embodiment includes the guide portions 76 that define the opening 74. With the guide portions 76, the laser printer 1 of the second illustrative embodiment can promote the oxidation-reduction reaction between ozone originated from the first gas O and VOCs originated from the second gas V. Thus, the laser printer 1 of the second illustrative embodiment can make effective use of ozone contained in the first gas O to effectively remove ozone and VOCs from air to be discharged by the exhaust fan 80.

Figure 7:
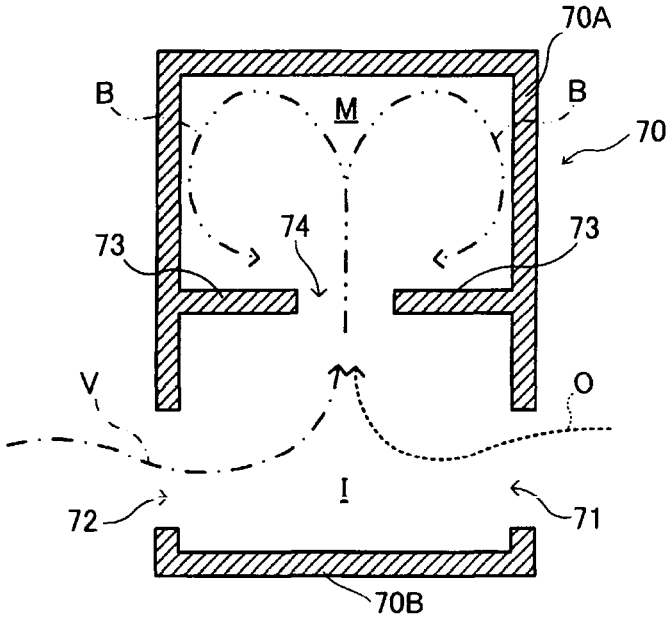
FIG. 7 is a cross sectional view schematically illustrating air flow paths in the introduction chamber and the mixture chamber according to a third illustrative embodiment.

A third illustrative embodiment will be described with reference to FIG. 7. The third illustrative embodiment of the disclosure also applies to the laser printer 1.

The laser printer 1 of the third illustrative embodiment is identical in basic structure to that of the first and second illustrative embodiments but different only in the structure of the introduction chamber I and the mixture chamber M. Thus, the following description will be made as to the introduction chamber I and the mixture chamber M of the third illustrative embodiment.

As in the case of the first and second illustrative embodiments, the introduction chamber I and the mixture chamber M of the third illustrative embodiment are defined by the guide body 70 disposed between the image formation unit 4 and the fixing unit 6. In addition, the introduction chamber I of the third illustrative embodiment is defined by the inner wall surfaces of the guide body 70 and the side frames (not shown), and includes the first introduction opening 71 and the second introduction opening 72. The mixture chamber M of the third illustrative embodiment is defined by the inner wall surfaces of the guide body 70, the inner wall surface of the main body 2 that constitutes the rear surface of the output tray 22, the outer surface of the fixing unit 6, and the side frames (not shown). The exhaust fan 80 is attached to one side of the mixture chamber M. In addition, the agitating member 75 is disposed in the mixture chamber M as in the case of the first and second illustrative embodiments.

In the third illustrative embodiment, the guide body 70 is formed with partition walls 73 which are located above the introduction chamber I. As shown in FIG. 7, one partition wall 73 protrudes from an inner wall surface of the guide body 70 that is disposed on the image formation unit 4 side, the other partition wall 73 protrudes from an inner wall surface of the guide body 70 that is disposed on the fixing unit 6 side, and the partition walls 73 protrude toward each other in a generally horizontal direction. A space formed between the partition walls 73 functions as the opening 74 of the third illustrative embodiment. As in the case of the first and second illustrative embodiments, the opening 74 of the third illustrative embodiment has a cross sectional area narrower than a cross sectional area of the mixture chamber M in a cross section parallel to the partition walls 73 or the opening 74. Thus, in the third illustrative embodiment, the gas mixture B led to the mixture chamber M through the opening 74 is distributed and agitated in the mixture chamber M.

Air flow in the introduction chamber I and the mixture chamber M in the third illustrative embodiment will be described.

As in the case of the first and second illustrative embodiments, when the exhaust fan 80 drives, the first gas containing ozone is led to the introduction chamber I via the first introduction opening 71. Concurrently, the second gas containing VOCs is led to the introduction chamber I via the second introduction opening 72.

Air existing in the introduction chamber I is led to the mixture chamber M via the opening 74, as in the case of the first and second illustrative embodiments. The opening 74 of the third illustrative embodiment is formed in a central portion of the introduction chamber I and the mixture chamber M in the front-rear direction of the laser printer 1. Thus, air, which is led from the introduction chamber I to the mixture chamber M, flows upward. In the mixture chamber M, the gas mixture B flows along the inner wall surface of the main body 2 that constitutes the rear surface of the output tray 22, to form or draw a clockwise whirl and a counterclockwise whirl in the vertical cross section. With this flow, the gas mixture B in the mixture chamber M can be greatly agitated. As a result, the laser printer 1 of the third illustrative embodiment can promote an oxidation-reduction reaction between ozone contained in the first gas O and VOCs contained in the second gas V, and effectively remove ozone and VOCs from air to be discharged by the exhaust fan 80.

In the laser printer 1 of the third illustrative embodiment, it is clear that effects similar to those brought about by the first and second illustrative embodiments can be appreciated. The laser printer 1 of the third illustrative embodiment can promote the oxidation-reduction reaction between ozone originated from the first gas O and VOCs originated from the second gas V. Thus, the laser printer 1 of the third illustrative embodiment can make effective use of ozone contained in the first gas O to effectively remove ozone and VOCs from air to be discharged by the exhaust fan 80.

The illustrative embodiments show, but are not limited to, the agitating member 75. Any type of agitating member may be used that can agitate air in the mixture chamber M as the exhaust fan 80 drives.

The second illustrative embodiment shows, but is not limited to, the guide portions 76 being inclined as shown in FIG. 6 to produce air flow in the form of a clockwise whirl in the mixture chamber M. For example, the guide portion 76 located on the image formation unit 4 side may be inclined downward at a predetermined angle, and the guide portion 76 located on the fixing unit 6 side may be inclined upward at a predetermined angle. In this case, air may flow like a counterclockwise whirl in the mixture chamber M, such that the oxidation-reduction reaction may be promoted between ozone originated from the first gas O and VOCs originated from the second gas V.

While the features herein have been described in connection with various example structures and illustrative aspects, it will be understood by those skilled in the art that other variations and modifications of the structures and aspects described above may be made without departing from the scope of the disclosures described herein. Other structures and aspects will be apparent to those skilled in the art from a consideration of the specification or practice of the features disclosed herein. It is intended that the specification and the described examples only are illustrative with the true scope of the disclosures being defined by the following claims.

What is claimed is:

1. An image forming apparatus, comprising:

an image forming unit configured to form an image on a recording medium, wherein a first gas is generated during image formation;

a fixing unit configured to fix the image onto the recording medium by heat, wherein a second gas is generated during image fixing by heat;

a guide body including a mixture chamber and an opening through which both the first gas and the second gas are guided into the mixture chamber to be mixed into a gas mixture; and a fan configured to discharge the gas mixture from the mixture chamber, wherein the guide body extends in a direction towards the fan such that the opening is elongated in the direction towards the fan.

2. The image forming apparatus according to claim 1, wherein ozone included in the first gas and odor components included in the second gas are mixed in the mixture chamber.

3. The image forming apparatus according to claim 1, wherein inner wall surfaces of the mixture chamber allow the gas mixture to flow such that the flow of the gas mixture along the inner wall surfaces forms a whirl in a cross section perpendicular to an exhaust direction in the mixture chamber.

4. The image forming apparatus according to claim 1, wherein the guide body includes a pair of guide portions defining the opening, the guide portions being configured to guide the gas mixture toward inner wall surfaces of the mixture chamber in a cross section perpendicular to an exhaust direction in the mixture chamber.

5. The image forming apparatus according to claim 1, wherein the guide body includes an introduction chamber configured to receive the first gas and the second gas and guide the first gas and the second gas to the opening.

6. The image forming apparatus according to claim 5, wherein the introduction chamber includes a first inlet for receiving the first gas to be guided to the opening and a second inlet for receiving the second gas to be guided to the opening.

7. The image forming apparatus according to claim 5, wherein the mixture chamber is disposed above the introduction chamber.

8. The image forming apparatus according to claim 1, wherein the guide body is disposed between the image forming unit and the fixing unit.

9. The image forming apparatus according to claim 1, further comprising an agitating member disposed in the mixture chamber, the agitating member being configured to mix the first gas and the second gas in the mixture chamber.

10. The image forming apparatus according to claim 1, wherein the opening has a cross sectional area narrower than a cross sectional area of the mixture chamber in a cross section parallel to the opening.

11. The image forming apparatus according to claim 1, wherein the image forming unit includes a charger and the first gas is generated by the charger during image formation.

12. The image forming apparatus according to claim 1, wherein the guide body includes a partition wall that defines the opening.

13. The image forming apparatus according to claim 1, wherein the guide body includes a pair of partition walls protruding from opposing inner walls of the guide body, and the opening is defined between the partition walls.

14. The image forming apparatus according to claim 1, wherein the opening is elongated in an exhaust direction of air discharged by the fan.

15. An image forming apparatus, comprising:

an image forming unit configured to form an image on a recording medium, wherein a first gas is generated during image formation;

a fixing unit configured to fix the image onto the recording medium by heat, wherein a second gas is generated during image fixing by heat;

a guide body including, an introduction chamber for receiving the first gas and the second gas, a mixture chamber that allows the first gas and the second gas to be mixed into a gas mixture, and an opening for allowing the introduction chamber to communicate with the mixture chamber, wherein the introduction chamber guides the first gas and the second gas to the opening; and a fan configured to discharge the gas mixture from the guide body, wherein the guide body extends in a direction towards the fan such that the opening is elongated in the direction towards the fan.

16. The image forming apparatus according to claim 15, wherein the opening is elongated in an exhaust direction of air discharged by the fan.

* * * * *